United States Patent [19]

Westhead

[11] 4,261,392

[45] Apr. 14, 1981

[54] DRYER FELT HAVING SOFT, BULKY SURFACE

[75] Inventor: William T. Westhead, Waycross, Ga.

[73] Assignee: Scapa Dryers, Inc., Waycross, Ga.

[21] Appl. No.: 932,409

[22] Filed: Aug. 9, 1978

[51] Int. Cl.[3] ..... D03D 15/00

[52] U.S. Cl. ..... 139/383 A; 139/412; 139/420 C; 139/414; 139/425 A

[58] Field of Search ..... 139/425 R, 383 R, 383 A, 139/408, 409, 410, 411, 412, 413, 414, 420 R, 426, 425 A, 420 D, 420 C; 162/348, DIG. 1; 428/280; 57/210

[56] References Cited

U.S. PATENT DOCUMENTS

| | | | |
|---|---|---|---|
| 1,811,573 | 6/1931 | Bacheldor et al. | 139/425 R |
| 2,098,993 | 11/1937 | Barrell | 139/383 A |
| 2,208,090 | 7/1940 | Whittier | 139/411 |
| 2,332,393 | 10/1943 | Neville | 139/383 A |
| 3,049,153 | 8/1962 | Jones | 139/426 |
| 3,653,961 | 4/1972 | Lefkowitz | 139/383 A |
| 4,024,895 | 5/1977 | Barron | 139/426 R |
| 4,093,512 | 6/1978 | Fleischer | 139/420 D |
| 4,159,618 | 7/1979 | Sokaris | 57/251 |

FOREIGN PATENT DOCUMENTS

| | | | |
|---|---|---|---|
| 1009696 | 11/1965 | United Kingdom | 139/383 A |

*Primary Examiner*—Henry Jaudon
*Attorney, Agent, or Firm*—Fleit & Jacobson

[57] ABSTRACT

A dryer felt having a soft, bulky top surface and comprising at least a top surface, which is defined by a plurality of machine direction yarns and a plurality of cross machine direction yarns interwoven according to a desired weave pattern. A preselected number of the yarns of the top surface are encapsulated yarns, the number being chosen to ensure that a major portion of the top surface is soft and bulky.

21 Claims, 6 Drawing Figures

DRYER FELT HAVING SOFT, BULKY SURFACE

BACKGROUND OF THE INVENTION

1. Field of the Invention

This invention relates to papermaking fabrics, in general, and to dryer felts having a soft, bulky top surface, in particular.

2. Description of the Prior Art

A conventional dryer felt consists of an endless conveyor belt made from a one-, two-, or three-plane fabric, wherein the various planes can be defined either by different groups of cross machine direction yarns, machine direction yarns or both. During the drying process, the upper plane, or top surface of the felt is in contact with the paper web being processed. Accordingly, it is desirable for the upper plane of the felt to have a smooth and soft surface to avoid undue marking of the finished paper. Various methods have been tried to produce a dryer felt having an upper surface which exhibits the desired smoothness and softness. While a close weave of the upper or top plane produces the desired smoothness, this advantage is offset by the comparatively high resistance of the dryer felt to the passage of water and water vapor therethrough; the material costs of a close weave felt are also quite high.

The use of soft spun yarns to replace the basic cross machine direction or filling yarns of the top plane has been tried. However, it was found that the resulting dryer felt was too unstable. Later, stuffer or center picks were added in an effort to increase the stability of dryer felts using soft yarns in the top plane. Although stability improved, the cost of producing such dryer felts was greatly increased.

Using cross machine direction or filling yarns made from a stiff core filament or fiber surrounded by a plurality of twisted filaments or fibers to replace the filling yarns of the top plane has also been tried. It has been found that, in use, the stiff core filament or fiber tends to protrude through the twisted-filament or fiber wrap and thereby causes paper marking problems.

There is, thus, a need for an economical, stable dryer felt which overcomes the paper marking problem noted above.

SUMMARY OF THE INVENTION

In general, the subject invention consists of a dryer felt having a soft, bulky top surface or face. A plurality of machine direction yarns and a plurality of cross machine direction yarns are interwoven according to a desired weave pattern to produce the top surface. A preselected number of the yarns of the top surface are encapsulated yarns having a core fiber encapsulated in a sheath or sleeve made from a material producing a soft, bulky texture. A sufficient number of encapsulated yarns are used to ensure that a major portion of the top surface is soft and bulky.

In one embodiment of the subject invention, a single-layer dryer felt having a soft, bulky top surface is provided by using encapsulated cross machine direction yarns.

In another embodiment of the subject invention, there is provided a duplex weave dryer felt having a base plane or surface and a top plane or surface. The base plane is defined by a plurality of cross machine direction yarns. The top plane, which is soft and bulky, is defined by a plurality of encapsulated cross machine direction yarns.

In a further embodiment of the subject invention, a triplex weave dryer felt is provided, having a base plane, a top plane and an intermediate plane. The base plane and the intermediate plane are each defined by a plurality of cross machine direction yarns. The top plane, which is soft and bulky, is defined by a plurality of encapsulated cross machine direction yarns.

By using the encapsulated yarns to replace the filling yarns in the top plane of both the duplex and triplex weave dryer felts, the problem of paper marking is diminished by the soft, bulky surface of the dryer felts. Other advantages of using the encapsulated yarns to replace the filling yarns are that yarn migration is eliminated, while at the sametime fabric stability is greatly increased.

It is, thus, an object of the present invention to provide an economical and stable dryer felt which is not plagued by paper marking problems.

It is another object of the present invention to provide a dryer felt having encapsulated filling yarns to define a soft, bulky top surface.

It is a further object of the present invention to provide a dryer felt having encapsulated machine direction yarns to define a soft, bulky surface.

It is yet another object of the present invention to provide a dryer felt having encapsulated machine direction and cross machine direction yarns to define a soft, bulky top surface.

It is yet a further object of the present invention to provide an economical and stable dryer felt which is not plagued by yarn migration.

Other objects and advantages of this invention will further become apparent hereinafter and in the drawings.

DESCRIPTION OF THE PREFERRED EMBODIMENTS

Figure 1A:
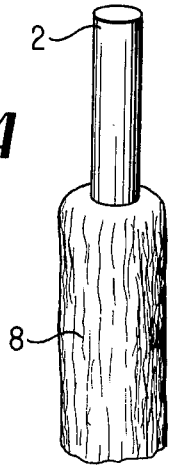
FIGS. 1A and 1B show, in perspective, two embodiments of encapsulated yarns in various stages of assembly.

In describing the preferred embodiments of the invention illustrated in the drawings, specific terminology will be resorted to for the sake of clarity. However, it should be understood that the invention is not to be limited to the specific terms so selected, and it is to be understood that each specific term includes all technical equivalents which operate in a similar manner to accomplish a similar purpose.

Figure 1B:
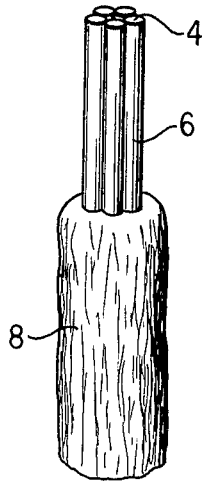

The subject invention will now be described with reference to the figures, in which FIGS. 1A and 1B illustrate two types of encapsulated yarns. At the heart of the encapsulated yarn is a monofilament core, designated as 2 in FIG. 1A and 4 in FIG. 1B. The monofilament core 2 is a monofilament of a single fiber, whereas the monofilament core 4 is composed of a bundle of synthetic fibers 6, treated with a high temperature resistent resin such as phenolic resin, to cause the bundle to act as a monofilament fiber in the woven fabric.

The fibers constituting the monofilament cores 2 and 4 are preferably made from polyester. However, the fibers can also be made from polyamides, aramids, acrylics and polyolefins. It is also possible to employ fine wire and/or rubber-type resin treated glass yarns as core materials.

Each of the monofilament cores 2 and 4 is encapsulated in a sheath or sleeve 8 made from a material producing a soft, bulky texture. Sleeve 8 may be of mineral fibers such as asbestos, natural fibers such as cotton or wool, or synthetic fibers such as polyamides, polyesters, acrylics or aramids. In one embodiment, the sleeve is produced by spun staple fibers in sliver, roving or yarn form. In another embodiment, the sleeve is produced by employing a yarn texturising process. In such a process, a yarn comprising a plurality of filaments made from man-made materials which are not originally or inherently crinkled are rendered bulky by causing the filaments to become crinkled. The plurality of filaments of the yarn is made up of a group of more than one substantially continuous filament, or a plurality of such groups of filaments. Such yarns are sometimes referred to in the textile arts as "textured" yarns. In yet another embodiment, the sleeve is produced by employing natural yarns which are originally or inherently crinkled, such as cotton or wool, and which are not inherently crinkled, such as bast fibers.

Figure 2:
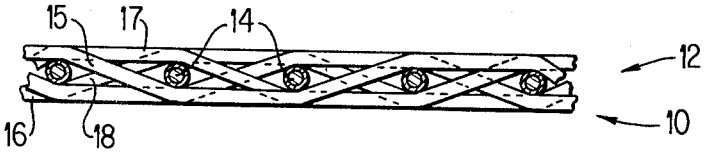
FIG. 2 is a longitudinal section of a single-layer dryer felt employing the subject invention.

One embodiment of the subject invention is illustrated in FIG. 2. A single-layer fabric, generally designated as 10, contains a top plane or surface 12. The top surface, which provides the face of the dryer felt, is defined by a plurality of encapsulated cross machine direction yarns 14, which are made from a synthetic monofilament or a synthetic multifilament core encapsulated in a sheath or sleeve made from a material producing a soft, bulky texture, such as a roving of acrylic fiber. The cross machine direction yarns 14 are interwoven in a binding relationship with a plurality of machine direction yarns, 15–18, in accordance with a desired weave pattern. The machine direction yarns, 15–18, are made from a synthetic monofilament, a synthetic multifilament, or spun staple fibers.

Figure 3:
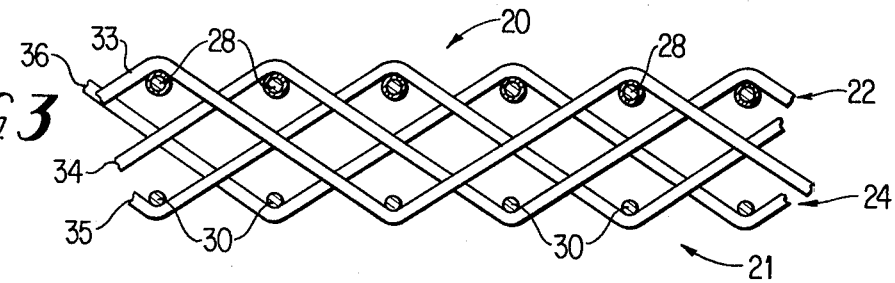
FIG. 3 is a longitudinal section of a duplex weave employing the subject invention.

Another embodiment of the subject invention is illustrated in FIG. 3. A duplex weave, generally designated as 20, contains a top plane or surface 22 and a bottom plane or surface 24. The top plane 22, which provides the face of the dryer felt, is defined by a plurality of encapsulated cross machine direction yarns 28, which are made from a synthetic monofilament or a synthetic multifilament core encapsulated in a roving or acrylic fiber. The bottom plane or surface 24, which provides the back of the dryer felt, is defined by a plurality of filling yarns 30, which are made from a synthetic monofilament, a synthetic multifilament or spun staple fibers. The yarn made from the multifilament, or the spun staple fibers is preferably stabilized by a resin treatment using for example phenolic resin; but this is not essential, and it would not be done with every type of dryer felt. The various yarns defining the planes are united or bound in place by a plurality of machine direction yarns 33 through 36. These yarns are also made from a synthetic monofilament, a synthetic multifilament, or spum staple fibers.

Figure 4:
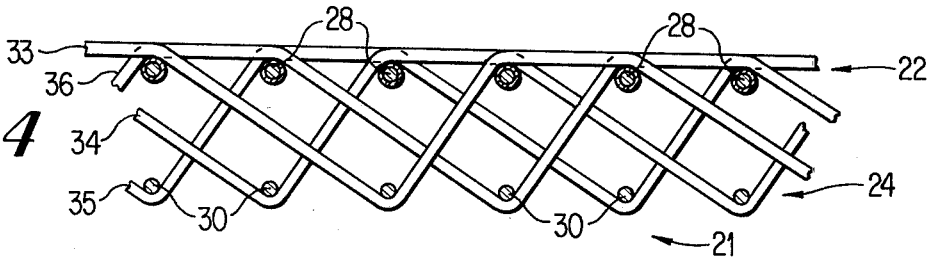
FIG. 4 is a longitudinal section of another duplex weave employing the subject invention.

It is to be understood that other duplex weave dryer felts can benefit greatly from employing the encapsulated yarns of the subject invention. As an example, another duplex weave dryer felt, generally designated as 21, is illustrated in FIG. 4, wherein like numbers denote like elements.

Figure 5:
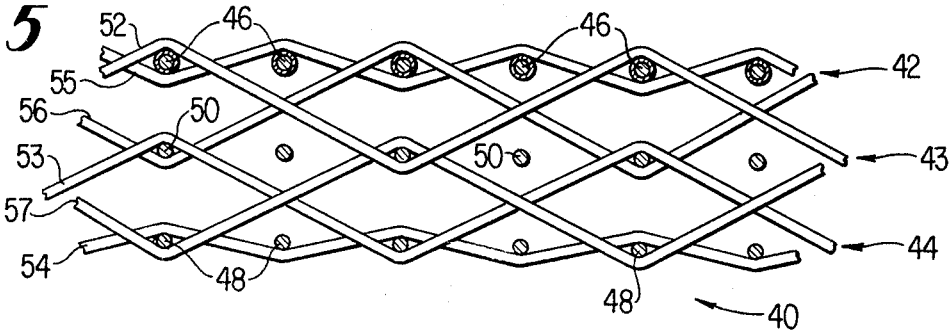
FIG. 5 is a longitudinal section of a triplex weave employing the subject invention.

Yet another embodiment of the subject invention is illustrated in FIG. 5, wherein a triplex weave dryer felt is disclosed. The dryer felt, generally designated as 40, contains a top plane or surface 42, a bottom plane or surface 44, and an intermediate plane 43. The bottom plane 44, which provides the back of the dryer felt, is defined by a plurality of cross machine direction yarns 48, which are made from a synthetic monofilament, a synthetic multifilament or spun staple fibers. The intermediate plane is defined by a plurality of cross machine direction yarns 50, which are also made from a synthetic monfilament, a synthetic multifilament or spun staple fibers. The top plane, which defines the face of the dryer felt, is defined by a plurality of encapsulated cross machine direction filling yarns 46. The yarns used to define the various planes are united or bound in place by a plurality of machine direction yarns 52 through 57. These yarns are also made from a synthetic monofilament, a synthetic multifilament or spun staple fibers.

It is also contemplated that encapsulated yarns may be used to provide a dryer felt having a soft, bulky top surface in other ways. Encapsulated yarns may replace some or all of the machine direction yarns, the filling yarns of the top surface being synthetic monofilament or synthetic multifilament yarns which may or may not be encapsulated in a sheath or sleeve made frodm a material producing a soft, bulky texture.

Obviously, many modifications and variations of the present invention are possible in light of the above teachings, and it is contemplated that the encapsulated yarns of the subject invention may not replace all of the top surface filling yarns in the various dryer felt embodiments. It is further contemplated that the diameter of the core fibers 2 and 4, as well as the diameter of the synthetic monofilament or the synthetic multifilament, used for the remaining yarns in the dryer felt, are in the range of about 5 to 50 mils, with a range of about 15 to 25 mils being preferred. It is, therefore, to be understood that within the scope of the appended claims, the invention may be practiced otherwise than as specifically described.

What I claim is:

1. A dryer felt for processing a paper web, said dryer felt comprising: a top surface, a plurality of machine direction yarns and a plurality of cross machine direction yarns interwoven in a binding relationship according to a desired weave pattern to produce said top surface; and a preselected number of said yarns of said top surface being encapsulated yarns, said number being chosen to ensure that a major portion of said top surface is soft and bulky, each of said encapsulated yarns comprising a plurality of filaments treated with a heat resistant resin so that said filaments together act as a monifilament core, and an encapsulating sheath surrounding the full length of said core, said sheath defining a soft, bulky outer surface which, when woven into said fabric, acts to prevent yarn migration of said encapsulated yarns in said fabric and wherein said encapsulated yarns reduced undue marking of said paper web while contributing to fabric stability.

2. The dryer felt according to claim 1, wherein the preselected yarns of said top surface are machine direction yarns.

3. The dryer felt according to claim 1, wherein the preselected yarns of said top surface are cross machine direction yarns.

4. The dryer felt according to claim 1, further comprising a base plane, and a second plurality of cross machine direction yarns arranged to define said base plane.

5. The dryer felt according to claim 4, further comprising an intermediate plane positioned between said top surface and said base plane, and a third plurality of cross machine direction yarns arranged to define said intermediate plane.

6. The dryer felt according to claim 1, wherein said sheath is made from a material chosen from the group consisting of asbestos, cotton, wool, synthetic fibers or aramid fibers.

7. The dryer felt according to claim 1, wherein said sheath is made from a material chosen from the group consisting of mineral fibers, natural fibers or man-made fibers.

8. The dryer felt according to claim 1, wherein the filaments of monofilament core are wire.

9. The dryer felt according to claim 1, wherein the filaments of said monofilament core are made from a treated glass fiber.

10. The dryer felt according to claim 1, wherein said resin is a phenolic resin.

11. The dryer felt according to claim 1, wherein said monofilament has a diameter in the range of about 5 to 50 mils.

12. The dryer felt according to claim 1, wherein the monofilament core has a diameter in the range of about 15 to 25 mils.

13. The dryer felt according to claim 1, wherein the monofilament core is made from a synthetic material chosen from the group consisting of polyesters, polyamides, aramids, polyolefins and acrylics.

14. The dryer felt according to claim 1, wherein the monofilament core is made from a material chosen from the group consisting of polyesters, polyamides and aramids.

15. A method of making a dryer felt for processing a paper web, said dryer felt having a soft, bulky surface, the method comprising the steps of weaving a fabric having a top surface, defining said top surface by a plurality of machine direction yarns and a plurality of cross machine direction yarns interwoven in a binding relationship, and creating a soft, bulky surface on a major portion of said top surface by having encapsulated yarns constitute a preselected number of said yarns of said top surface, each of said encapsulated yarns comprising a plurality of filaments treated with a heat resistant resin so that said filaments together act as a monofilament core, and an encapsulating sheath surrounding the full length of said core, said sheath defining a soft, bulky outer surface which, when woven into said fabric, acts to prevent yarn migration of said encapsulated yarns in said fabric, and wherein encapsulated yarns reduce undue marking of said paper web while contributing to fabric stability.

16. The method of claim 15, wherein the preselected yarns of said top surface are machine direction yarns.

17. The method of claim 15, wherein the preselected yarns of said top surface are cross machine direction yarns.

18. The method according to claim 15, further comprising the step of selecting an encapsulated yarn having said monofilament core, made from a synthetic material, and said sheath, made from a soft, bulky material, surrounding said core fiber.

19. The method according to claim 18, further comprising the step of selecting said synthetic material for said monofilament core from the group consisting of polyesters, polyamides, aramids, polyolefins and acrylics.

20. The method according to claim 18, further comprising the step of selecting said soft, bulky material for said sheath from the group consisting of asbestos, cotton, wool, synthetic fibers, and aramid fibers.

21. The method according to claim 18, further comprising the step of selecting said soft, bulky material for said sheath from the group consisting of mineral fibers, natural fibers and synthetic fibers.

* * * * *